US007621479B2

(12) United States Patent
Matzenmüller

(10) Patent No.: US 7,621,479 B2
(45) Date of Patent: Nov. 24, 2009

(54) SUPPLY-ROLL SWITCHING APPARATUS

(75) Inventor: Jürgen Matzenmüller, Bellamont (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 164 days.

(21) Appl. No.: 11/732,118

(22) Filed: Apr. 2, 2007

(65) Prior Publication Data

US 2007/0228206 A1 Oct. 4, 2007

(30) Foreign Application Priority Data

Apr. 3, 2006 (DE) ..... 10 2006 015 477

(51) Int. Cl.
*B65H 21/00* (2006.01)

(52) U.S. Cl. ..... 242/554.2; 242/556; 156/157; 156/159; 156/502; 156/504; 156/505

(58) Field of Classification Search ..... 242/554, 242/554.2, 555.3, 555.4, 556, 556.1; 156/157, 156/159, 502, 504, 505
See application file for complete search history.

(56) References Cited

U.S. PATENT DOCUMENTS

| | | | | | |
|---|---|---|---|---|---|
| 3,740,296 | A * | 6/1973 | McDonald | 242/555.4 |
| 3,753,833 | A * | 8/1973 | Bassett et al. | 156/504 |
| 3,920,502 | A * | 11/1975 | Tokuno | 156/504 |
| 3,971,525 | A * | 7/1976 | Winslow | 242/470 |
| 4,149,682 | A * | 4/1979 | Gustafson et al. | 242/571.3 |
| 4,842,681 | A * | 6/1989 | Bader et al. | 156/504 |
| 5,033,688 | A * | 7/1991 | Georgitsis et al. | 242/554.2 |
| 5,354,006 | A * | 10/1994 | Roder | 242/555.3 |
| 5,975,457 | A * | 11/1999 | Forbes | 242/552 |
| 6,451,145 | B1 * | 9/2002 | Forbes | 156/159 |
| 7,135,083 | B2 * | 11/2006 | Middelstadt et al. | 156/157 |
| 2001/0016120 | A1 | 8/2001 | Hara et al. | 396/387 |
| 2005/0139310 | A1 | 6/2005 | Fraczak | 156/157 |
| 2005/0241774 | A1 | 11/2005 | Hart | 156/502 |

FOREIGN PATENT DOCUMENTS

| | | |
|---|---|---|
| DE | 19735418 | 2/1999 |
| DE | 697 07 920 | 3/2003 |
| EP | 0167917 | 1/1986 |

* cited by examiner

*Primary Examiner*—John Q Nguyen
*Assistant Examiner*—Juan J Campos
(74) *Attorney, Agent, or Firm*—Andrew Wilford

(57) ABSTRACT

An apparatus for switching a strip feed between supply rolls has first and second supports displaceable in a direction independently parallel to each other between an outer reload position and an inner supply position and respective first and second shafts on the supports extending parallel to the direction and adapted to carry respective rolls of strip. The strip is pulled off one of the rolls in the supply position of the respective support and fed continuously or in steps to a user. Respective cutters on each of the supports cut the respective strip, and respective gluers on each of the supports glue a leading end of the respective strip to a trailing end of the strip of the other roll.

14 Claims, 12 Drawing Sheets

SUPPLY-ROLL SWITCHING APPARATUS

FIELD OF THE INVENTION

The present invention relates to a supply-roll switching apparatus. More particularly this invention concerns an apparatus that connects the leading end of a strip wound on a fresh supply roll to the trailing end of a strip being pulled of another supply roll.

BACKGROUND OF THE INVENTION

In many production and packaging systems where strip material is pulled off a supply roll either continuously or in closely succeeding steps, it is necessary to join the trailing end of the strip on the currently feeding roll to the leading end of a fresh roll so that there is no need to stop operations. Such on-the-fly roll switching frequently has to be done at high speed and has to be transparent, that is imperceptible in the downstream packaging or production operation.

As a rule, as described for instance in U.S. Pat. No. 6,500,288, published US patent application 2005/0239310, and WO 1998/002372, it is standard to mount the two supply rolls on respective parallel shafts immediately adjacent each other, and to provide a fast-acting splicer between them capable of joining the trailing end of the expiring roll to the leading end of the fresh roll. Once the changeover is completed, the empty core of the depleted roll is pulled off its shaft and is replaced with a fresh roll whose leading end is threaded to the splicer so it is ready for use.

Examples of applications can be found in the textile industry, printing machines and particularly also in the packaging industry, which all must meet high requirements in terms of purity and flawlessness when packaging pharmaceutical products. Furthermore, due to the finite length of the material strip provided on the supply roll, replacement of the supply roll on a regular basis is required, requiring automatic switchover from the active supply roil being used in the production process and the standby roll available as backup.

OBJECTS OF THE INVENTION

It is therefore an object of the present invention to provide an improved roll-switching apparatus.

Another object is the provision of such an improved roll-switching apparatus that overcomes the above-given disadvantages, in particular that automatically switches from the depleted or nearly depleted active roll to the full standby roll and that can be easily reloaded between changeovers.

SUMMARY OF THE INVENTION

An apparatus for switching a strip feed between supply rolls. The apparatus has according to the invention first and second supports displaceable in a direction independently parallel to each other between an outer reload position and an inner supply position, respective first and second shafts on the supports extending parallel to the direction and adapted to carry respective rolls of strip, feeder means for pulling the strip off one of the rolls in the supply position of the respective support and feeding it continuously or in steps to a user, respective cutter means on each of the supports for cutting the respective strip, and respective gluer on each of the supports for gluing a leading end of the respective strip to a trailing end of the strip of the other roll.

In other words according to the invention with an apparatus of the type mentioned above for preparing the splicing operation all splicers are supported displaceably in the direction defined by the support shaft associated with each roll axis and each of the splicers comprises a cutter and a glue joiner.

This design according to the invention creates several advantages. To start with there is improved accessibility to the two splicers that alternately carry the active roll and the standby roll. Furthermore, when the active roll is unwound and requires replacement with a full standby roll, the user can perform the necessary manipulations in a plane that is offset from the plane of the current feeding material strip, thus preventing interference with production with the current material strip by the user. In addition, the provision of a respective cutter and glue joiner on each of the splicers ensures that the material strip provided on the standby roll at the free end of the strip can assume a precisely define starting position.

For this purpose it is advantageous that a counter-blade and a fluid-powered, normally pneumatic, cutting blade are provided in the cutter, between which blades the material strip runs. Furthermore it is advantageous if for the secure fixation of the material strip the cutter comprises a brake or clamp, so that the position of the material strip is reliably defined prior to, during, and after cutting.

Using a simple design, this is achieved in that the clamp is associated with a vacuum suction element. Furthermore, a fluid-powered adjustable clamping plate is provided on the clamp. This clamping plate lends itself to clamping the material strip over a large surface, while the vacuum suction element is preferably available for the free end of the material strip.

So as to achieve orderly sequential operation when connecting the two material strips, the glue joiner is associated with a fluid-powered adjustable clamping roller that creates a spacing between one material strip and the other material strip and prevents premature bonding.

So as to allow easy transfer of the material strip from the cutter to the glue joiner and also to fix the position of the material strip securely and precisely on the glue joiner, the glue joiner is associated with at least one vacuum suction element for the material strip, to which end the glue joiner furthermore comprises vacuum channels for an adhesive tape to be attached to the material strip.

So as to facilitate replacement of the unwound active roll with a new standby roll, the arrangement is such that the support shafts thereof comprise fluid-powered fins for tensioning the associated roll as well as a disk brake with electro-pneumatic pressure control. Thus the rolls can be locked to the respective shafts.

The apparatus described above allows the user to prepare and complete the process of bonding the two material strips on the active roll and on the standby roll. However, the, time at which the splicing operation as such must be performed has to be determined as well. The design is therefore such that each splicer has a sensor for detecting the end of the strip of the associated roll. This the sensor operates inductively to determine the rotational speed of the respective support shaft.

Since the production process preferably is not stopped during the splicing operation, furthermore the system must continue the feed of the material strip, even during roll changeover. For this purpose it is provided that the material strip is guided on the active roll by a looper pivotable between a working position and a splicing position. The looper typically has a pair of arms urged apart by spring force and each carrying a plurality of idler rollers. The strip passes back and forth between the idler rollers and when the arms are spread, a considerable length is carried on them. When feed of the strip to the looper stops, the arms pivot toward each other so that the strip continues to feed out.

So as to compensate for tolerances, the design is such that the glue joiner is supported in a spring-loaded fashion.

Furthermore, a rubberized feed roller is provided for advancing the material strip. This roller is active during normal operation between two splicing operations and furthermore can be used to flatten the splice against a counter-roller.

It is advantageous if a direct current motor is provided for driving the feed roller. This motor is associated with a gear mechanism.

So as to feed the cut material strip with precision, a pneumatic drive mechanism comprising an electro-magnetic clutch is provided.

Alternatively, it is also possible to provide a servo-motor for driving the rubberized feed roller and for advancing the cut material strip. This servo motor at the same time assumes the task of the direct current motor mentioned immediately above.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
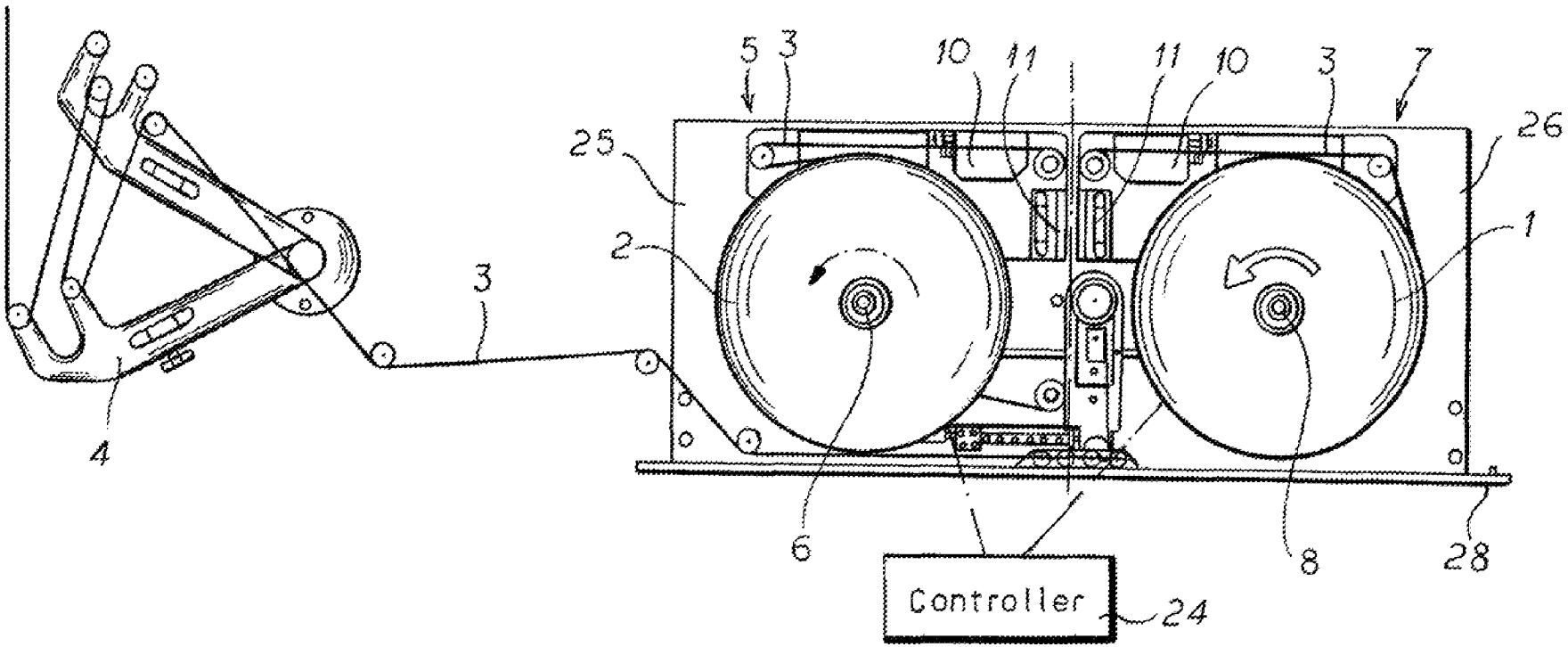
FIG. 1 is a partly schematic end view of the system in accordance with the invention.
Figure 2:
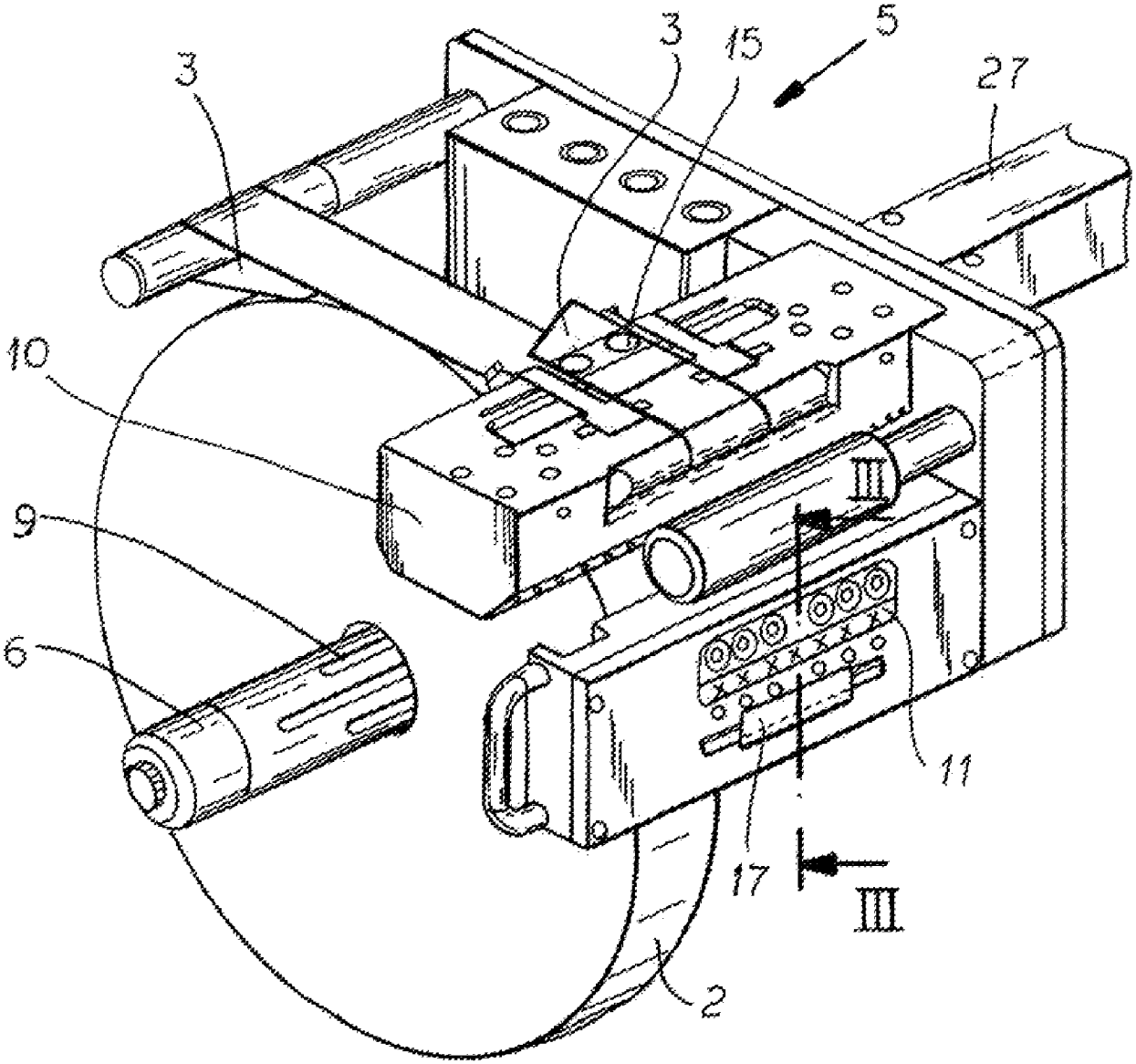
FIG. 2 is a perspective view of one of the splicers.

As seen in FIG. 1 an apparatus pulls a material strip from an active roll or a standby roll 2. The term active roll 1 means the material strip 3 is pulled off this roll 1 for the production process and fed through a looper 4 pivotable between a working position and a splicing position to further processing stations. The standby roll 2 is stationary while the active roll 1 is being unwound, and the looper 4 allows the strip.3 to stop briefly upstream while it continues to feed out downstream. To allow uninterrupted production, the trailing end of the material strip 3 on the active roll 1 must be bonded to the leading end of the material strip 3 on the standby roll 2 so this roll 2 can then become the active roll. Thus the terms "active roll" and "standby roll" are relative and depend from their functions at a given time and will constantly switch back and forth as the feed is switched between the rolls 1 and 2.

The apparatus comprises a first splicer 5 having a support plate 25 carrying a first shaft 6 and a second splicer 7 having a support plate 26 carrying a second shaft 8 parallel to the first shaft 6. Each shaft 6 and 8 has radially extendable fins 9 for gripping and locking rotationally to the respective roll 1 or 2, meaning the active roll 1 or the standby roll 2, as well as a disk brake with electro-pneumatic pressure control and a sensor 29 (FIG. 3) for monitoring rotation, all forming part of and connected to a controller 24. The two splicer-support plates 25 and 26 are carried on respective parallel rails 27 for movement parallel to the axes of the shafts 6 and 8 relative to a machine frame 28 (FIG. 1) between an inner supply or feed position and an outer reload position.

Figure 3:
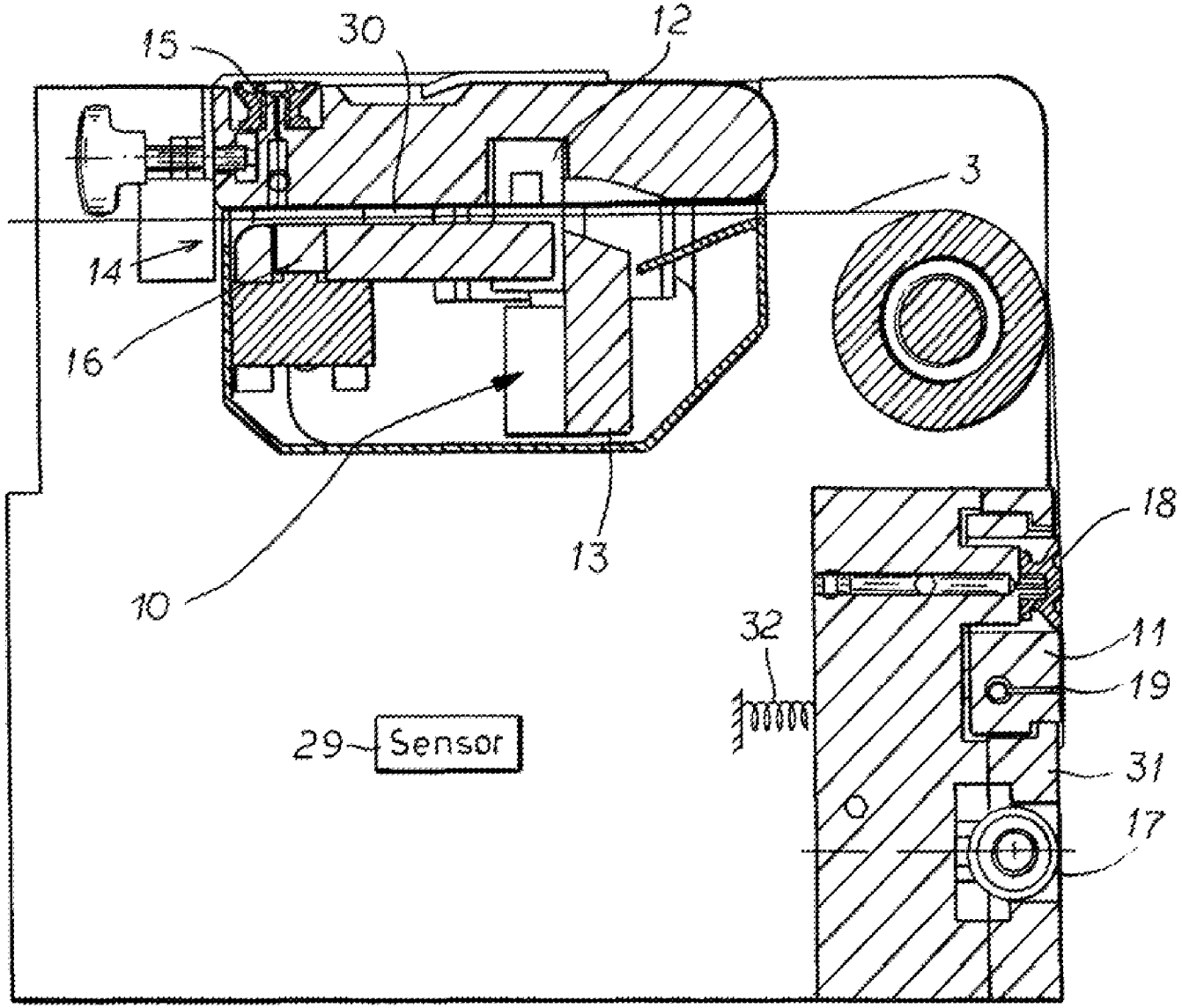
FIG. 3 is a larger-scale section taken along line III-III of FIG. 2.

Furthermore, each splicer 5 and 7 also comprises a cutter 10 and a glue joiner 11 supported on springs 32 (FIG. 3) for tolerance compensation and defining a vertical face 31. The cutter 10 has a fixed blade 12 and a fluid-powered displaceable blade 13 flanking a feed slot 30 and between which the material strip 3 from the respective roll 1 or 2 passes (FIG. 3). Furthermore, each cutter 10 is associated with a clamp 14 for solidly arresting the respective material strip 3. Each clamp 14 is associated with a respective vacuum suction element 15 and has a fluid-powered movable clamping plate 16.

The glue joiner 11 is associated with a pressurizing media-actuated, adjustable clamping roller 17 (FIG. 4) and comprises a vacuum suction element 18 as well as vacuum channels 19 for fixing the position of an adhesive tape 20 to be attached to the material strip 3.

The sensor 29 works inductively to determine the rotation rate of the respective shaft 6 or 8. This rotation rate is inherently directly related to the effective outside diameter of the respective roll, so it can be used to accurately determine when the current supply of strip 3 is nearly exhausted.

This apparatus functions as follows:

The starting point is the position of FIG. 1 in which the active roll 1 is on the right splicer 7 and the standby roll 2 is on the left splicer 5. Thus the active roll 1 previously carried in the left splicer 5 has been removed from the support shaft 6 by relaxing the fins 9 and replaced by a full standby roll 2. This splicer 5 is reloaded and worked on according to the invention in the outer reload position, that is with the new roll 2 in a plane well offset from that of the active roll 1 so there is no chance of interfering with the strip 3 currently being payed out therefrom.

Figure 4A:
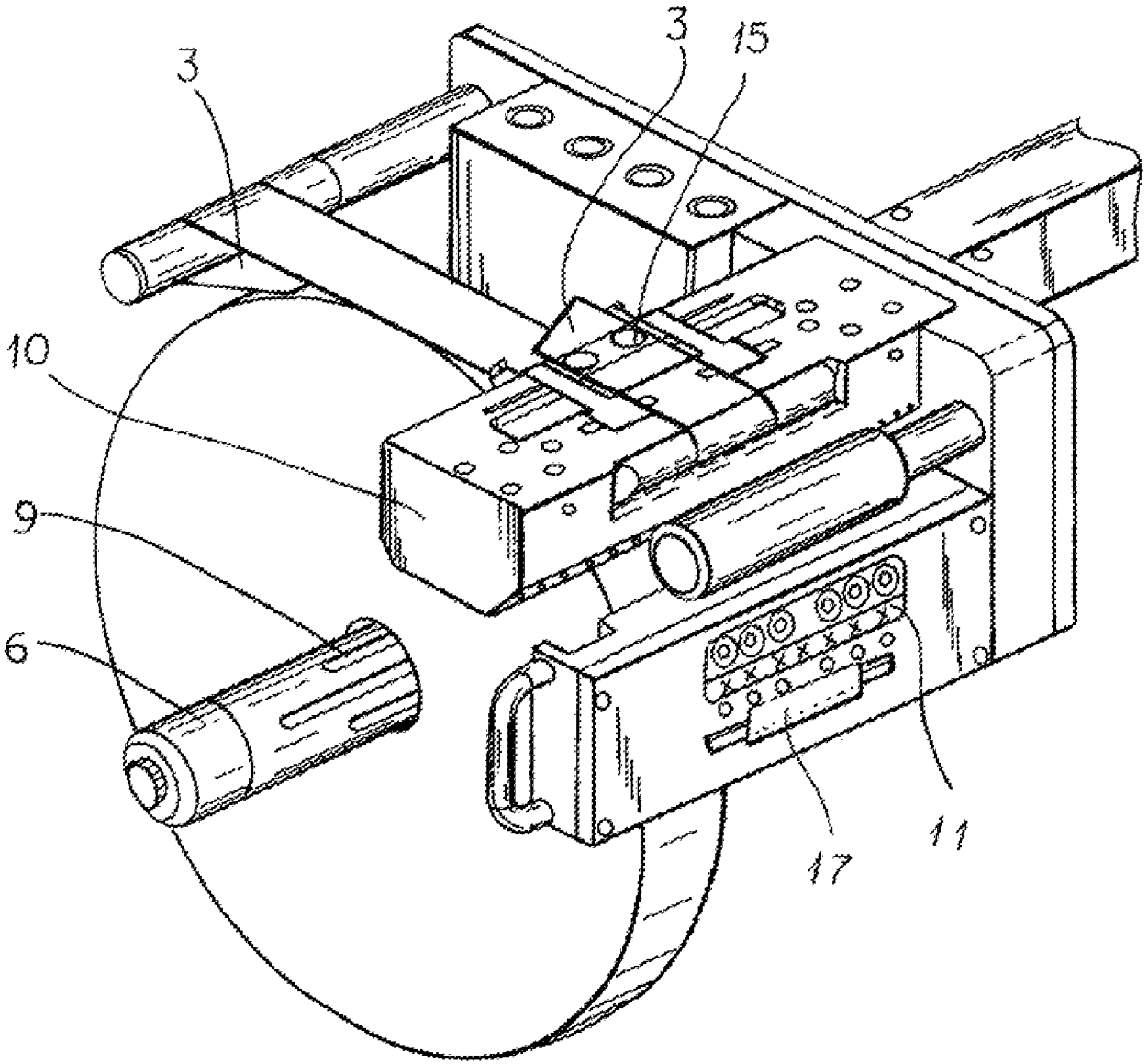
FIGS. 4A-4D are views like FIG. 2 showing the one splicer in successive operational positions.
Figure 4B:
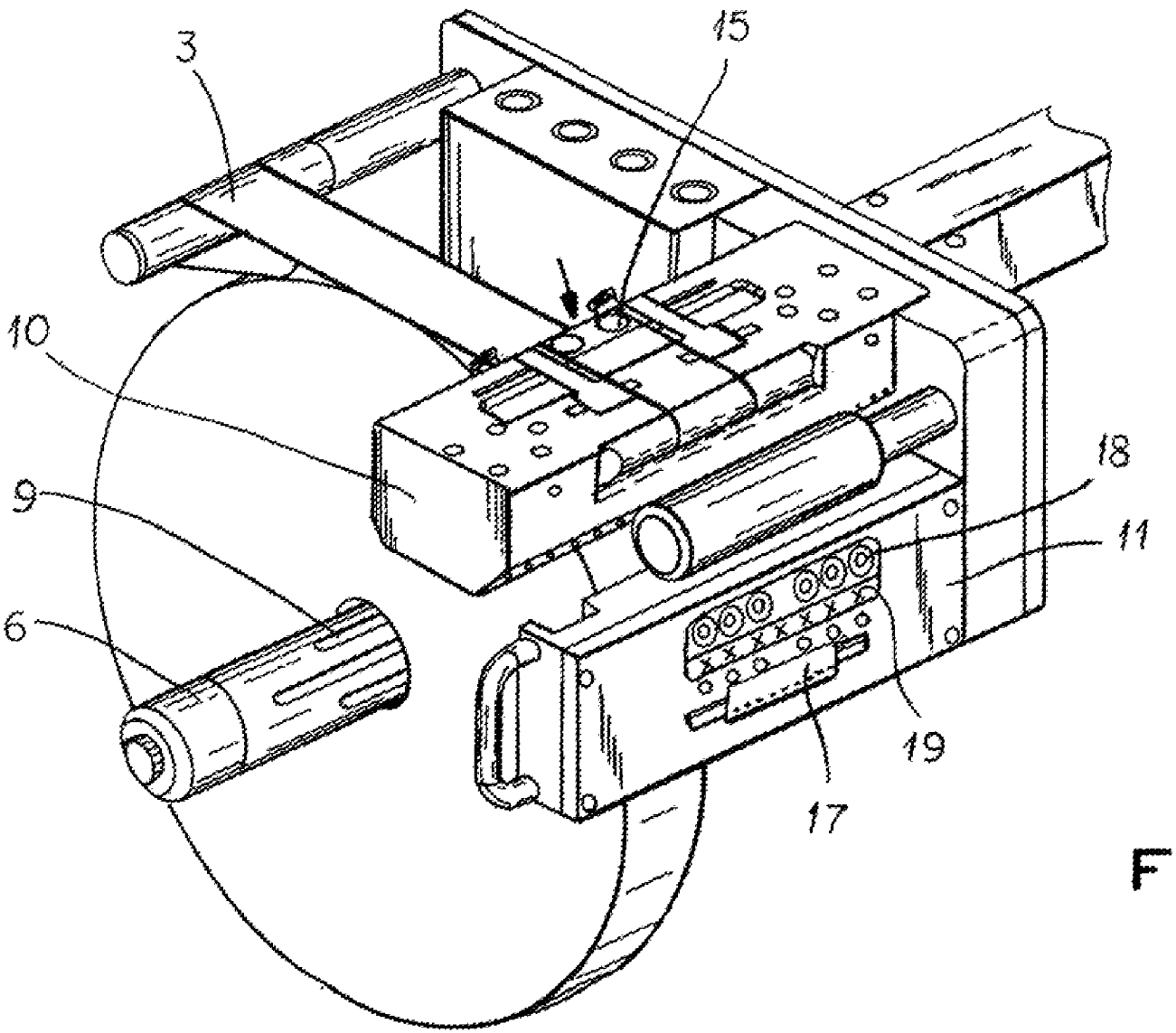

To prepare the splicing operation, the operator pulls the leading end of the material strip 3 off the standby roll 2 and threads it through the slot 30 in the pulled out slicer 5, past the cutter 10. The strip 3 must be kept fairly taut and aligned on the correct strip path. As soon as the correct position of the material strip 3 has been reached, the clamp 14 is activated and then the cutter 10 in order to produce a flawless, non-frayed, undamaged or non-bent leading end of the strip (FIG. 4A). This leading end of the strip is threaded through and held by the clamp 14 (FIG. 4B).

Figure 4C:
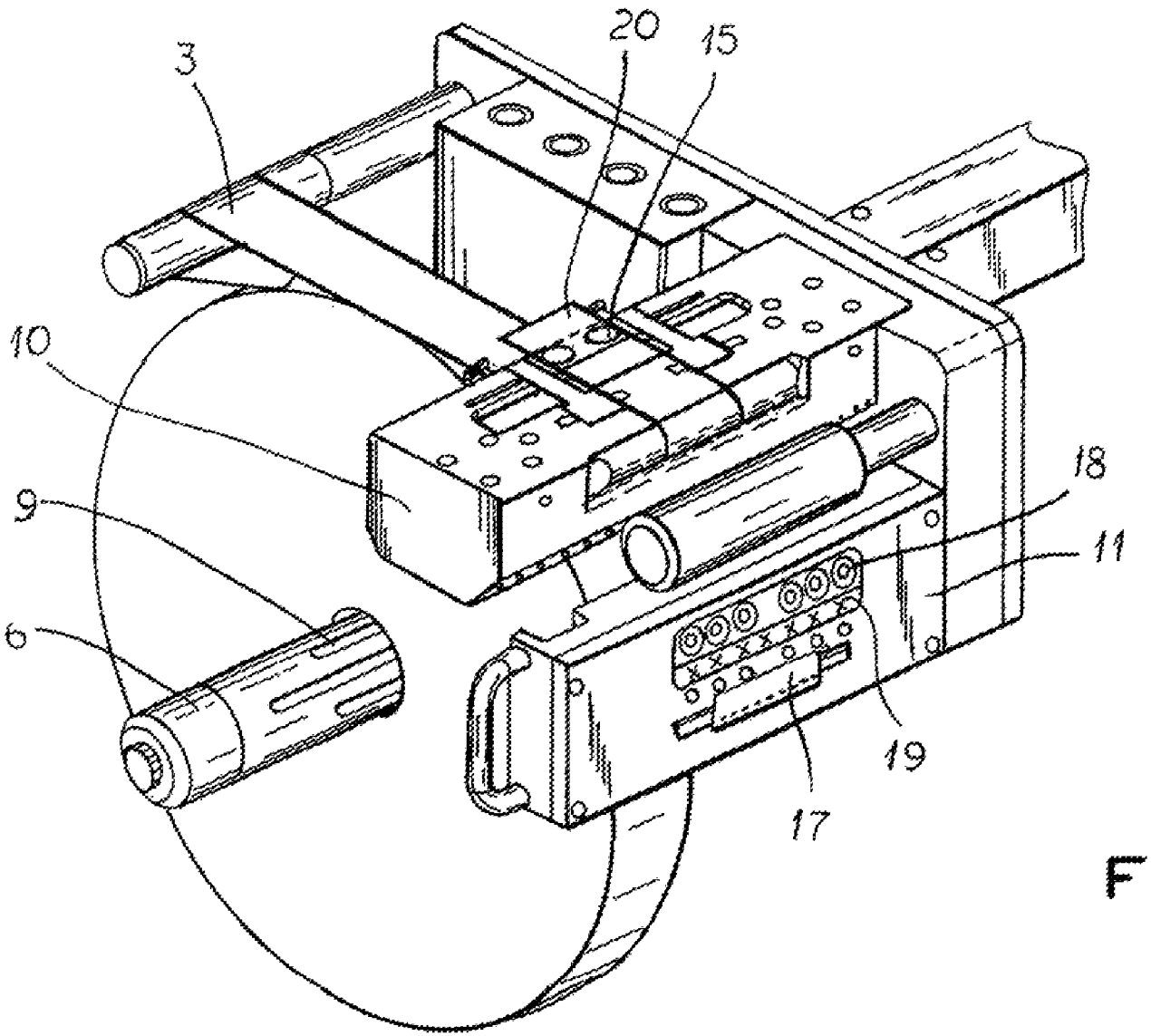
Figure 4D:
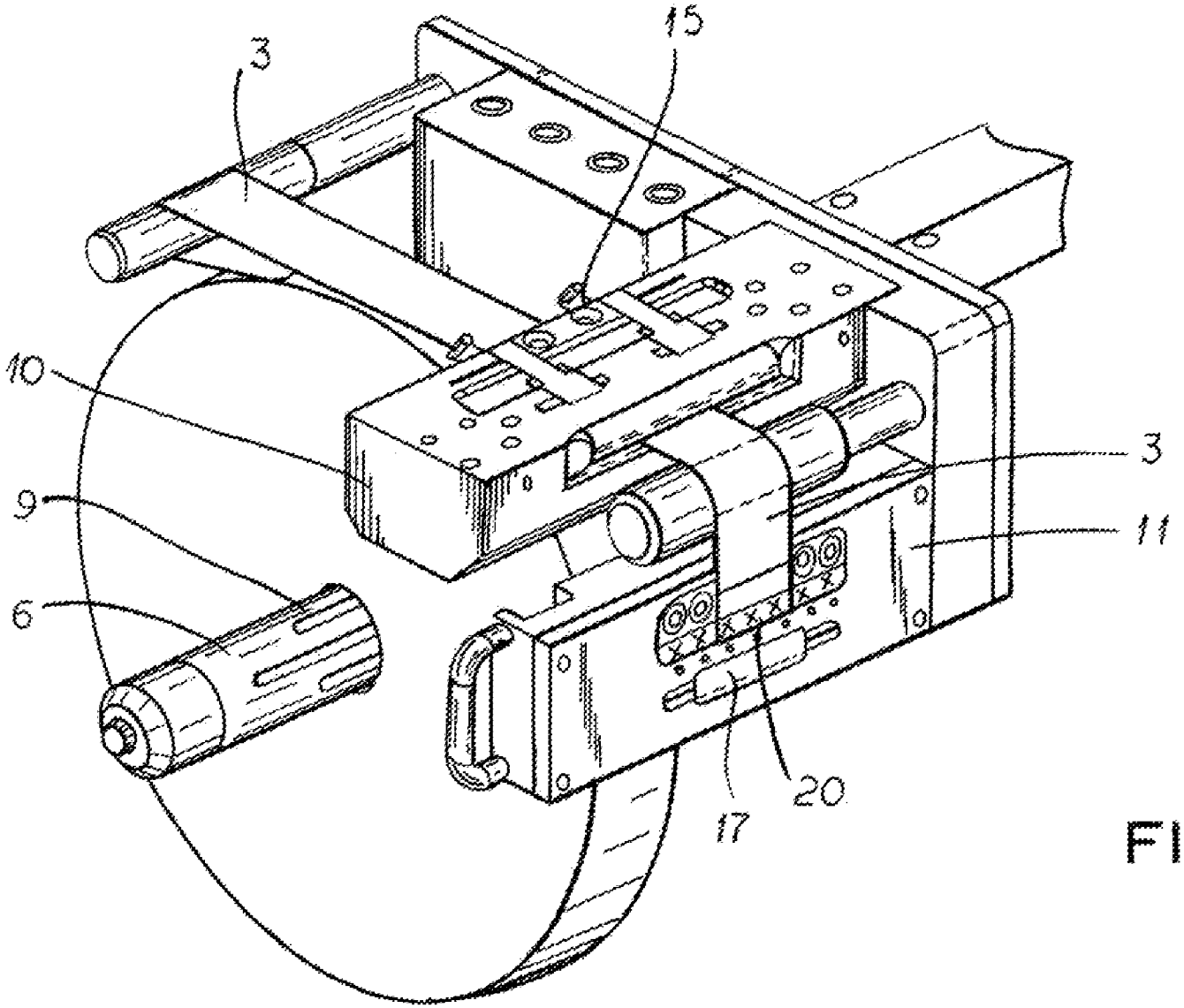

With the apparatus according to the invention, the splicing operation is performed using an adhesive tape 20 that is attached to the material strip 3 from above, half on and half projecting past the freshly cut leading end. It is possible to provide the user with a marker line so that he or she can fit the adhesive tape 20 centered with the end of the material strip 3 and thereby the splicing point. To prevent catching on the splicing point, it is recommended to cut the free end of the material strip 3 at an angle (FIG. 4C). The end of the material strip 3 prepared this way is pulled through the cutter 10 and pivoted 270° downward and applied to the glue joiner 11 whose vacuum suction element 18 as well as the vacuum channels 19 hold the taped free end of the strip 3 flatly on the vertical face 31. After these steps, the preparations to be performed by the user are complete and the splicer 5 can be pushed back into the feed/supply position for the subsequent automatic splicing/changeover operation.

Figure 5A:
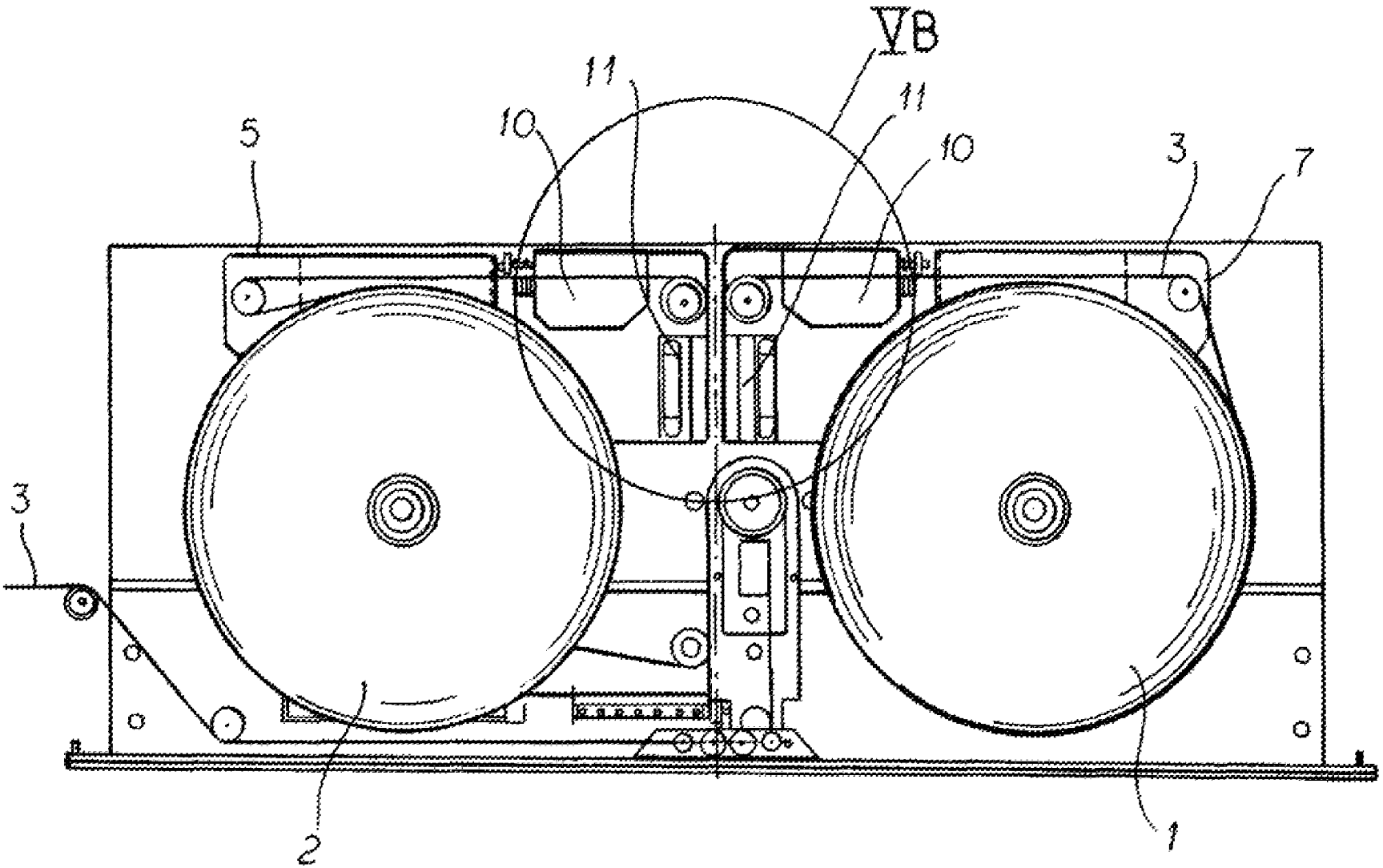
FIG. 5A is a large-scale view like FIG. 1.
Figure 5B:
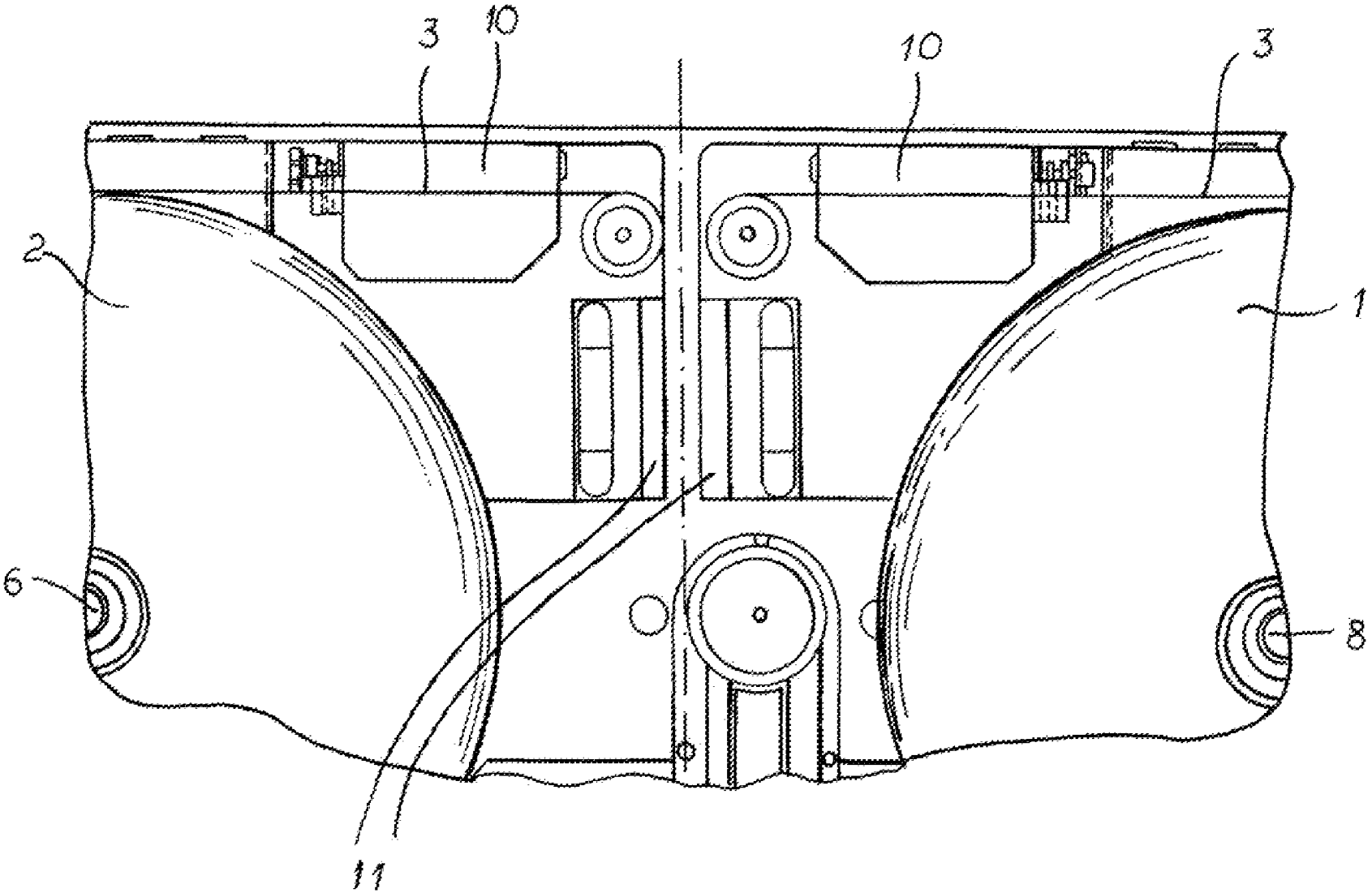
FIGS. 5B-5D are views of the region indicated at VB in FIG. 5A illustrating different operational positions of the apparatus.
Figure 5C:
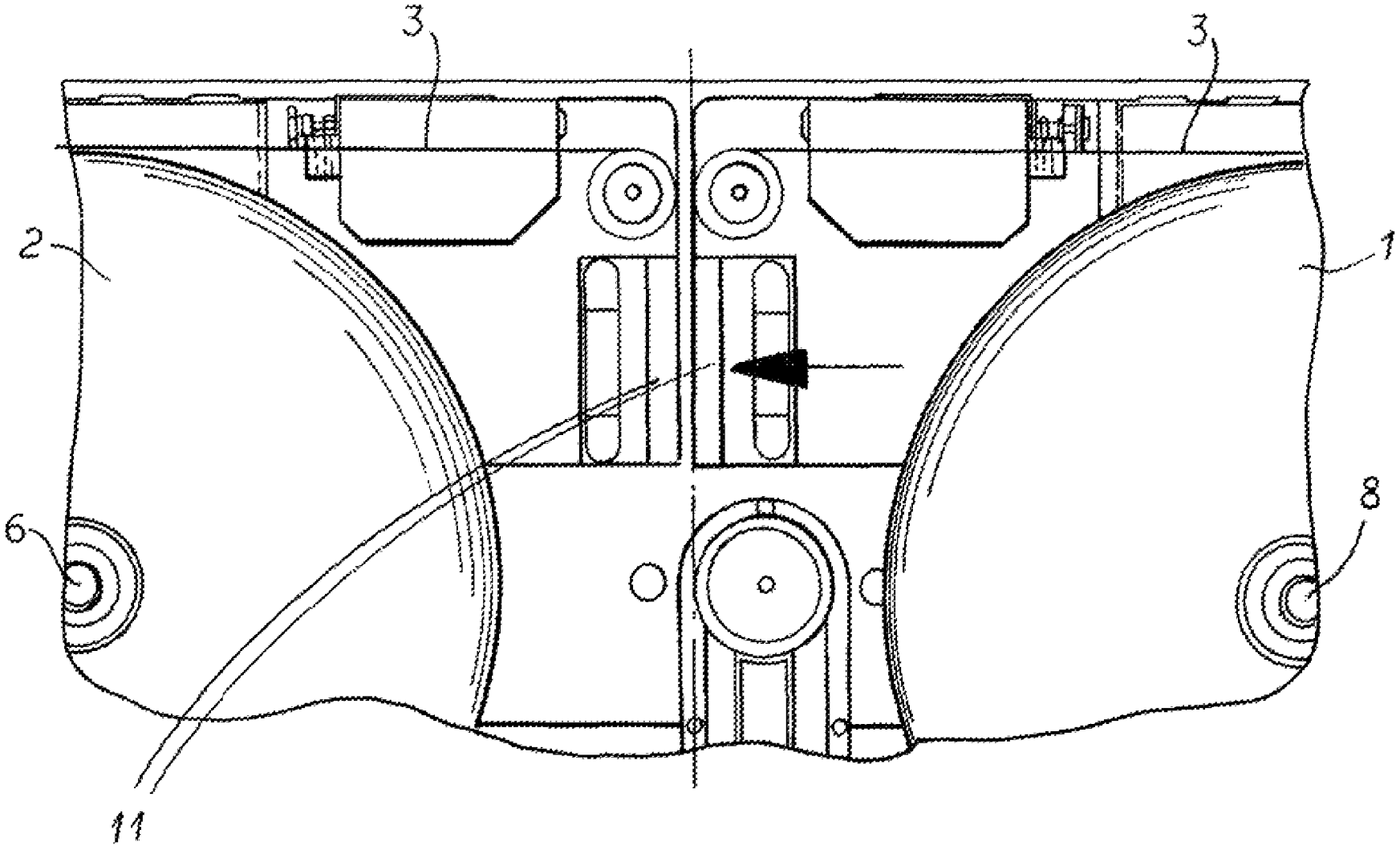

When the respective inductive sensor 29 detects a drop in the rotational speed and/or slowed revolutions of the support shaft 8 for the active roll 1, the loose strip end of the active roll 1 is clamped in the other splicer 7 by its clamp 14. The glue joiner 11 of the splicer 7 carrying the active roll 1 is extended and at the same time the clamping roller 17 of the glue joiner 11 from the other splicer 5 is actuated (FIG. 5C). Continued feed is meanwhile guaranteed by the supply of material strip 3 fed by the looper 4.

Figure 5D:
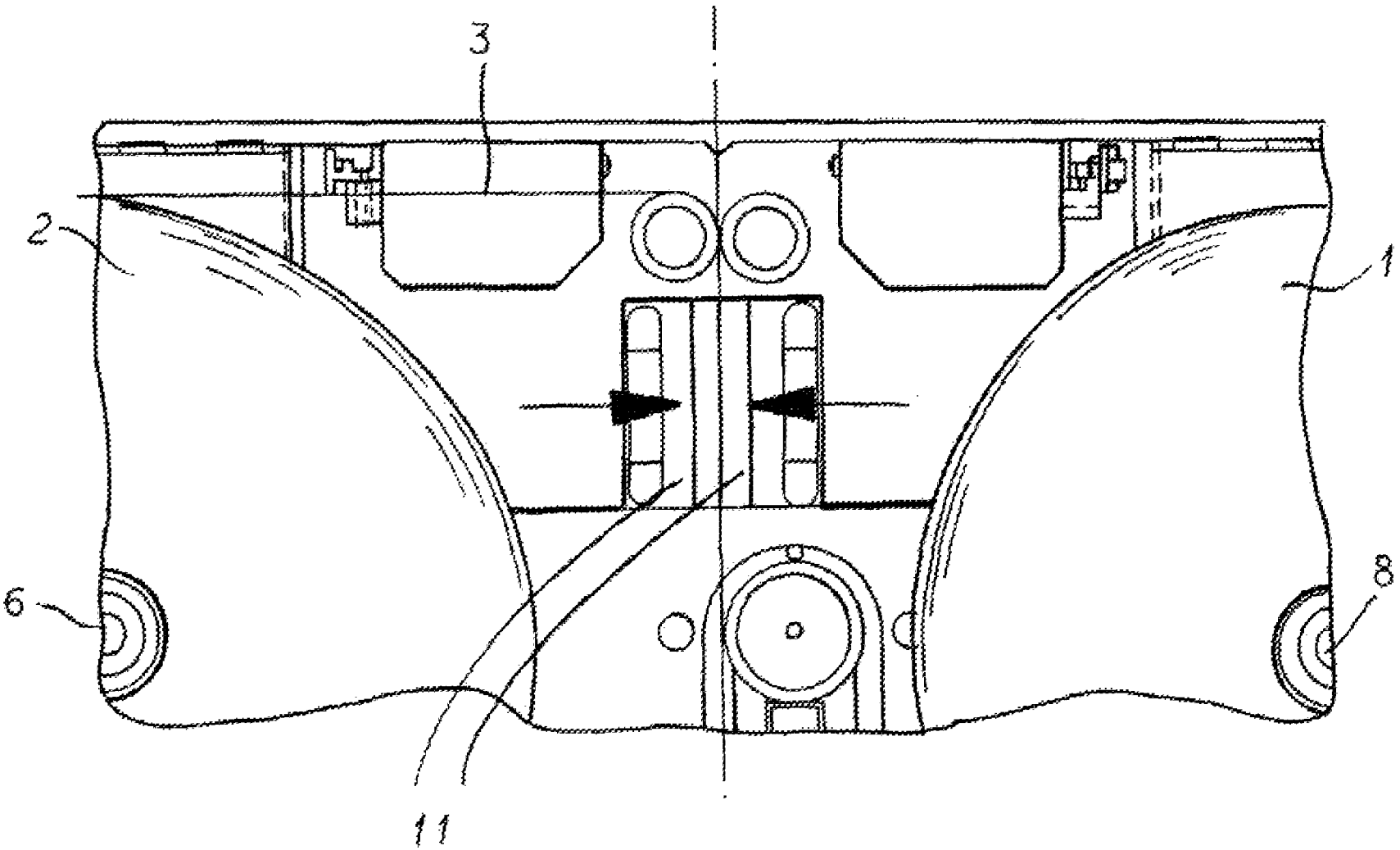
Figure 6:
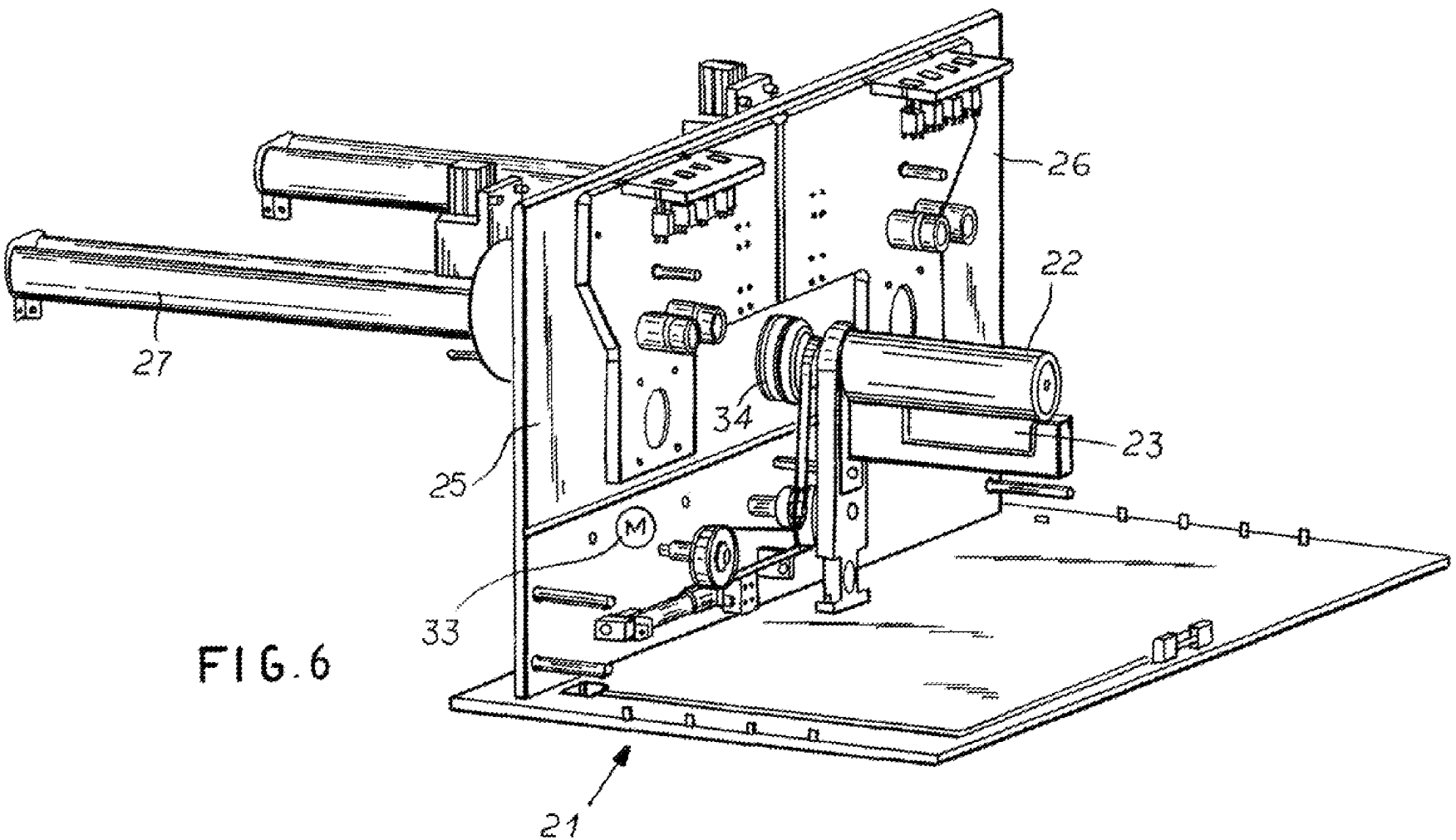
FIG. 6 is a perspective view of the system with the two feeder/splicers removed for clarity of view.

The cutting apparatus 10 of the second splicer 7 carrying the active roll 1 cuts the material strip 3 and the end of the material strip 3 of the splicer 7 carrying the active roll 1 is positioned on the respective glue joiner 11. Thereafter, the glue joiner 11 of the splicer 5.carrying the standby roll 2 (FIG. 5D) pushes out to press the two faces 31 together, thereby splicing the two strips 3 together. Thereafter, the vacuum present on all vacuum suction elements 18 and vacuum channels 19 is turned off and the clamp 14 is opened of the splicer 5 is opened. The two glue joiners 11 are retracted away from each other and the material strip 3 is then pulled off the roll 2 and becomes the active roll 1 to continue supplying the looper 4 and continue production. The advance of the material strip 3 during the production process, is assisted by a rubberized feed roller 22 used also for flattening the splice against a counter-roller 23. A direct-current motor 33 is provided for driving the feed roller 22 via a transmission 34.

So as to feed the cut material strip 3 with precision, a pneumatic drive 21 comprising an electromagnetic clutch is provided.

I claim:

1. An apparatus for switching a material strip on a first roll with another material strip on a second roll, the apparatus having:

a first splicer having a first support shaft having a first rotational axis for the first roll; and a second splicer having a second support shaft having a second rotational axis parallel to the first rotational axis for the second roll, each of the splicers being mounted for preparation of the splicing operation displaceably in a direction defined by the axis of the corresponding support shaft, each of the splicers comprising respective cutter means and respective gluing means.

2. The strip-switching apparatus defined in claim 1 wherein the cutter means of each splicer includes a pair of blades at least one of which is movable relative to the other.

3. The strip-switching apparatus defined in claim 2 wherein the splicers comprise respective clamps adjacent the respective cutter means, the clamps being operable to grip and arrest the respective strips.

4. The strip-switching apparatus defined in claim 3 wherein the splicers comprise respective vacuum grippers adjacent the respective cutter means operable to hold the respective strip against a face of the respective support.

5. The strip-switching apparatus defined in claim 3 wherein each clamp includes a clamp plate engageable with the respective strip.

6. The strip-switching apparatus defined in claim 3 wherein the gluing means of each splicer includes a respective roller, the roller of each gluing means being pressable against the roller of the other gluing means.

7. The strip-switching apparatus defined in claim 3 wherein the splicers comprise respective vacuum grippers on the respective faces adjacent the respective gluing means.

8. The strip-switching apparatus defined in claim 3 wherein the splicers comprise respective vacuum grippers for holding a piece of tape attached to a respective strip end against the respective face of the respective gluing means.

9. The strip-switching apparatus defined in claim 1 wherein each shaft has fins engageable with the respective rolls to lock same rotationally to the respective shaft.

10. The strip-switching apparatus defined in claim 1 wherein each of the splicers comprises respective sensor means on the splicers for detecting when the respective roll is about to be empty.

11. The strip-switching apparatus defined in claim 10 wherein the sensor means are each an inductive rotation sensor coupled to the respective shaft.

12. The strip-switching apparatus defined in claim 1, further comprising a looper in a plane extending through the splicers and the inner supply positions between the splicers and the user, the strip running through the looper.

13. The strip-switching apparatus defined in claim 1 wherein each splicer comprises respective spring means resiliently supporting the respective gluing means on the respective support.

14. The strip-switching apparatus defined in claim 1 wherein each splicer has a respective feed roller engaged with the respective strip between the respective gluing means and the user.

* * * * *